US008888260B2

(12) United States Patent
Hayashi et al.

(10) Patent No.: US 8,888,260 B2
(45) Date of Patent: Nov. 18, 2014

(54) LIQUID-JET HEAD AND IMAGE FORMING APPARATUS

(71) Applicants: Keisuke Hayashi, Kanagawa (JP); Tomohiko Koda, Kanagawa (JP)

(72) Inventors: Keisuke Hayashi, Kanagawa (JP); Tomohiko Koda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/778,271

(22) Filed: Feb. 27, 2013

(65) Prior Publication Data

US 2013/0242012 A1 Sep. 19, 2013

(30) Foreign Application Priority Data

Mar. 13, 2012 (JP) ..... 2012-055525

(51) Int. Cl.
*B41J 2/175* (2006.01)
*B41J 2/14* (2006.01)

(52) U.S. Cl.
CPC .... *B41J 2/17563* (2013.01); *B41J 2002/14362* (2013.01); *B41J 2/14274* (2013.01); *B41J 2002/14403* (2013.01)
USPC ..... 347/93

(58) Field of Classification Search
USPC ..... 347/93
See application file for complete search history.

(56) References Cited

U.S. PATENT DOCUMENTS 6,045,216 A 4/2000 Sasaki
6,139,674 A * 10/2000 Markham et al. ..... 156/252
6,254,229 B1 * 7/2001 Bohorquez et al. ..... 347/93
7,651,205 B2 1/2010 Hayashi
7,775,652 B2 * 8/2010 Taira et al. ..... 347/93
7,871,153 B2 1/2011 Hayashi
8,042,918 B2 10/2011 Hayashi
8,070,279 B2 12/2011 Miura
8,348,407 B2 1/2013 Matsufuji et al.
8,366,242 B2 2/2013 Koda et al.
2006/0001718 A1 * 1/2006 Shimizu ..... 347/93
2011/0298872 A1 12/2011 Hayashi
2012/0182356 A1 7/2012 Hayashi et al.

FOREIGN PATENT DOCUMENTS

JP H09-066607 3/1997
JP 2006-289643 10/2006
JP 2007-160821 6/2007
JP 2008-213196 9/2008
JP 2010-105251 5/2010

* cited by examiner

*Primary Examiner* — Stephen Meier
*Assistant Examiner* — Alexander D Shenderov
(74) *Attorney, Agent, or Firm* — Cooper & Dunham LLP

(57) ABSTRACT

A liquid-jet head includes nozzles ejecting liquid drops, individual liquid chambers in communication with the corresponding nozzles, a common liquid chamber supplying the liquid to the individual liquid chambers, and a filter member filtering the liquid inside the common liquid chamber. The filter member includes a thin layer having pores and a thick layer on a circumferential part of the thin layer, the thick layer being bonded to the first common liquid chamber member; the thin layer includes a first surface having the thick layer and a second surface opposite to the first surface, a circumferential part of the second surface being bonded to the second common liquid chamber member with an adhesive; and part of or all the pores in the circumferential part of the second surface are exposed in a direction toward the thick layer, and the adhesive overflows into the pores.

9 Claims, 19 Drawing Sheets

LIQUID-JET HEAD AND IMAGE FORMING APPARATUS

BACKGROUND OF THE INVENTION

1. Field of the Invention

The disclosures herein relate to a liquid-jet head and an image forming apparatus.

2. Description of the Related Art

An inkjet recording apparatus is generally known as an example of a liquid-jet recording type image forming apparatus having a recording head formed of a liquid-jet head (liquid-drop jet head) ejecting liquid drops, such as a printer, a facsimile machine, or a plotter, or a combination of these functions.

The liquid-jet head is normally provided with a filter part configured to filter a liquid inside a channel in order to prevent ejecting from malfunctioning, that is, to prevent foreign particles contained in the ejecting liquid from clogging nozzles or prevent foreign particles contained in the ejecting liquid from being attached to edges of the nozzles to adversely affect ejecting directions, which may result in curved ejecting directions.

Japanese Laid-open Patent Publication No. 2007-160821 discloses a structure having a filter member sandwiched between a first metallic member and a second metallic member, in which the first metallic member and the second metallic member are mutually bonded with an adhesive applied around the filter member in a circular configuration.

RELATED ART DOCUMENTS

Patent Document

Patent Document 1: Japanese Laid-open Patent Publication No. 2007-160821

When the filter member is bonded between the two members with the adhesive and the adhesive overflows the edge of the filter into a filter region, filter pores are clogged with the adhesive, thereby lowering a filtering function.

Further, since it is difficult to eliminate air bubbles from a downstream side of the filter member, air-bubble eliminating properties may need to be improved.

Accordingly, it is a general object of the present invention to prevent the adhesive bonding the filter member between the two members from overflowing into the filter region while improving the air-bubble eliminating properties, which eliminates one or more problems caused by the limitations and disadvantages of the related art.

SUMMARY OF THE INVENTION

According to one embodiment, there is provided a liquid-jet head that includes a plurality of nozzles configured to eject liquid drops; a plurality of individual liquid chambers in communication with the nozzles; a common liquid chamber configured to supply the liquid to the individual liquid chambers; and a filter member configured to filter the liquid inside the common liquid chamber. The common liquid chamber includes a first common liquid chamber member on an upstream side of the filter member, and a second common liquid chamber member on a downstream side of the filter member, and the filter member includes a thin layer having a plurality of pores and a thick layer disposed on a circumferential part of the thin layer. The thick layer of the filter member is bonded to the first common liquid chamber member, the thin layer of the filter member includes a first surface on which the thick layer is formed and a second surface opposite to the first surface, a circumferential part of the second surface of the thin layer being bonded to the second common liquid chamber member with an adhesive. Among the pores formed in the thin layer of the filter member, a part or all of the pores are exposed in a direction toward the thick layer, the part or the all of the pores being formed in the circumferential part of the second surface of the thin layer bonded to the second common liquid chamber, and the adhesive overflows into the part or the all of the pores formed in the circumferential part of the second surface of the thin layer.

Additional objects and advantages of the embodiments will be set forth in part in the description which follows, and in part will be obvious from the description, or may be learned by practice of the invention.

It is to be understood that both the foregoing general description and the following detailed description are exemplary and explanatory only and are not restrictive of the invention as claimed.

BRIEF DESCRIPTION OF THE DRAWINGS

Other objects and further features of embodiments will be apparent from the following detailed description when read in conjunction with the accompanying drawings, in which.

DESCRIPTION OF THE PREFERRED EMBODIMENTS

Figure 1:
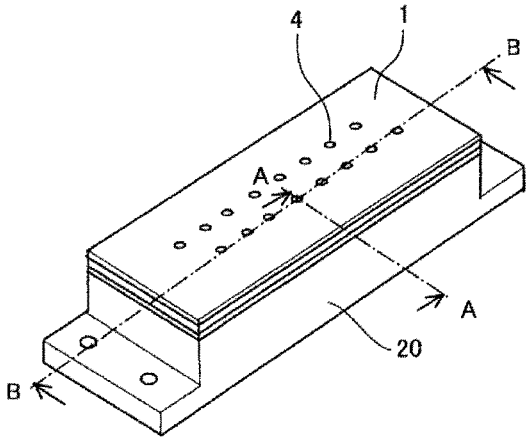
FIG. 1 is an external perspective diagram illustrating a liquid-jet head according to a first embodiment.
Figure 2:
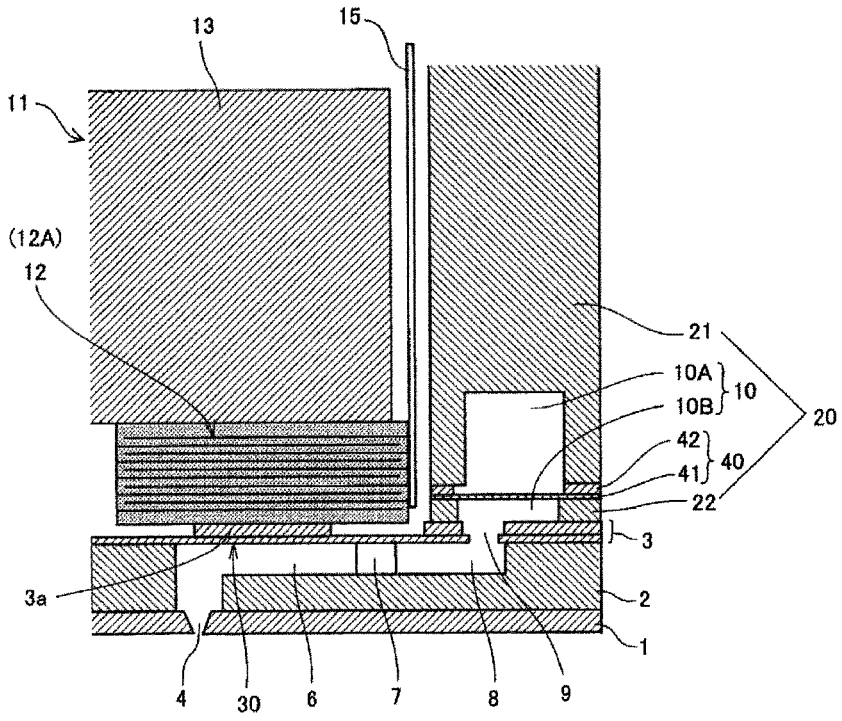
FIG. 2 is a cross-sectional diagram illustrating the liquid-jet head in a direction orthogonal to a nozzle array direction (a liquid chamber longitudinal direction) taken along an A-A line of FIG. 1.
Figure 3:
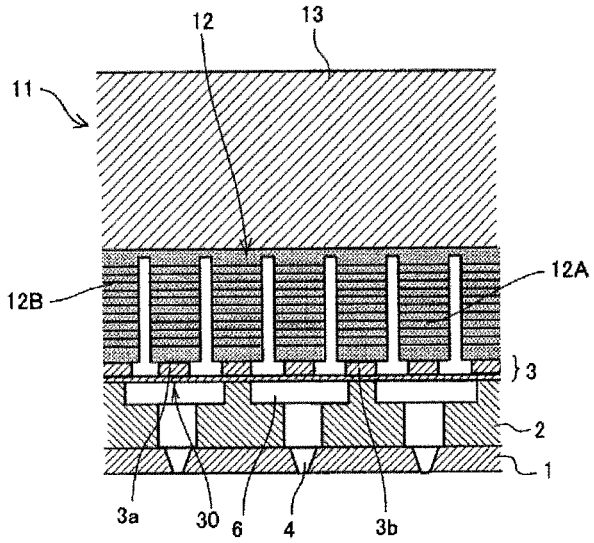
FIG. 3 is a cross-sectional diagram illustrating the liquid-jet head in a direction orthogonal to a nozzle array direction (a liquid chamber short direction) taken along a B-B line of FIG. 1.

Preferred embodiments are described below, with reference to the accompanying drawings. First, a liquid-jet head according to a first embodiment is described with reference to FIGS. 1 to 4. Note that FIG. 1 is an external perspective diagram illustrating a liquid-jet head according to a first embodiment, FIG. 2 is a cross-sectional diagram illustrating the liquid-jet head in a direction orthogonal to a nozzle array direction (a liquid chamber longitudinal direction) taken along an A-A line of FIG. 1, and FIG. 3 is a cross-sectional diagram illustrating the liquid-jet head in a direction orthogonal to a nozzle array direction (a liquid chamber short direction) taken along a B-B line of FIG. 1.

The liquid-jet head according to the first embodiment includes a nozzle plate 1, a channel plate (a liquid chamber substrate) 2, and a diaphragm member 3 serving as a thin-film member that are bonded in a layered manner. The liquid-jet head according to the first embodiment further includes an actuator 11 configured to displace the diaphragm member 3, and a common liquid chamber member 20.

In the liquid-jet head according to the first embodiment, the nozzle plate 1, the channel plate 2, and the diaphragm member 3 form, as individual channels, individual liquid chambers (may also be called "pressurizing liquid chambers", "pressure chambers", "pressurizing chambers", and "channels") 6 in communication with respective nozzles 4 configured to eject liquid drops, a liquid supply channel 7 configured to supply a liquid to the individual liquid chamber 6 and serving as a fluid resistance part, and a liquid introducing part 8 communicating with the liquid supply channel 7.

Accordingly, the liquid-jet head according to the first embodiment supplies a liquid to the plural individual chambers 6 from a common liquid chamber 10 serving as a common channel of the common liquid chamber member 20 through an opening 9 formed in the diaphragm member 3, the liquid introducing part 8, and the liquid supply channel 7.

Note that the nozzle plate 1 is formed of a metallic plate made of nickel (Ni), which is produced by electroforming. The nozzle plate 1 is not limited to that formed of the metallic plate made of nickel (Ni), but may be formed of other types of the metallic plate, a resin member, a layered member of a resin layer and a metallic layer, etc. The nozzle plate 1 may include the nozzles 4 having a diameter of 10 to 35 μm corresponding to the respective individual liquid chambers 6, and may be bonded to the channel plate 2 with an adhesive. Further, a water repellent layer is formed on a liquid drop ejecting surface (i.e., a surface in an ejecting direction: an ejecting surface, or a surface opposite to the liquid chamber 6 side) of the nozzle plate 1.

The channel plate 2 includes grooves forming the individual liquid chambers 6, the liquid supply channel 7, and the liquid introducing part 8, which are formed by etching a monocrystalline silicon substrate. Note that the channel plate 2 may be formed by etching a metallic plate such as a SUS substrate with an acid etching liquid, or may be formed by machining such as press working.

The diaphragm member 3 includes a deformable oscillating region 30 corresponding to the individual liquid chamber 6. The deformable oscillating region 30 serves as a wall surface member forming a wall surface of the individual liquid chamber 6 of the channel plate 2.

The piezoelectric actuator 11 is disposed on a side opposite to the individual liquid chambers 6 of the diaphragm member 3, and includes an electromechanical transducer element serving as a driving part (i.e., an actuator part, and a pressure generating part) configured to deform the oscillating region 30 of the diaphragm member 3.

The piezoelectric actuator 11 includes a layered piezoelectric member 12 bonded on plural base members 13 with an adhesive, and desired numbers of piezoelectric columns 12A and 12B are formed in a pectinate configuration at predetermined intervals corresponding to one layered piezoelectric member 12.

The piezoelectric columns 12A and 12B of the piezoelectric member 12 are formed as the same elements. However, they are differentiated as the piezoelectric column 12A serving as a driven pressure column (or a driven column) configured to be driven by being supplied with a driving waveform, and the piezoelectric column 12B serving as a non-driven pressure column (or a non-driven column) utilized as a supporting column configured not to be supplied with a driving waveform, to be driven.

The driven column 12A is bonded to an island-shaped projection part 3*a* formed in the oscillating region 30 of the diaphragm member 3. Further, the non-driven column (i.e., the piezoelectric column 12B) is bonded to a projection part 3*b* of the diaphragm member 3.

The piezoelectric member 12 includes alternate layers of piezoelectric layers and internal electrodes, and external electrodes are formed by drawing the internal electrodes to end faces to which a FPC 15 for supplying driving signals to the external electrodes of the piezoelectric member 12 serving as a flexible printed wiring board is connected.

The common liquid chamber member 20 includes a first common liquid chamber member 21, a second common liquid chamber member 22, and a filter member 40 configured to filter a liquid disposed between the first and the second common liquid chamber members 21 and 22. The common liquid chamber 10 is divided into two common liquid chambers, that is, an upstream side common liquid chamber 10A and a downstream side common liquid chamber 10B.

In the liquid-jet head having the above configuration, the driven column 12A may be contracted by lowering a voltage applied to the driven column 12A below the reference potential, and a volume of the individual liquid chamber 6 may be expanded by lowering the oscillating region of the diaphragm member 3. Accordingly, the liquid flows inside the individual liquid chamber 6. Thereafter, the driven column 12A is elongated in a layered direction by raising the voltage applied to the driven column 12A, and the volume of the individual liquid chamber 6 is contracted by deforming the oscillating region of the diaphragm member 3 in a nozzle direction. Accordingly, the liquid inside the individual liquid chambers 6 is pressurized to discharge (eject) liquid drops from the nozzles 4.

When the voltage applied to the driven column 12A returns to the reference potential to restore the oscillating region 30 of the diaphragm to an initial position, the individual liquid chamber 6 expands to generate a negative pressure. As a result, the liquid is supplied into the individual liquid chamber 6 via the liquid supply channel 7 from the common liquid chamber 10. When the oscillations of meniscus faces in the nozzles 4 are damped and stabilized, the liquid-jet head is moved for a next operation.

Note that a method for driving the liquid-jet head is not limited to the above example, but the liquid-jet head may be driven by applying the driving waveform to the piezoelectric column 12A in different ways so as to cause the piezoelectric column 12A to contract or expand.

Figure 4:
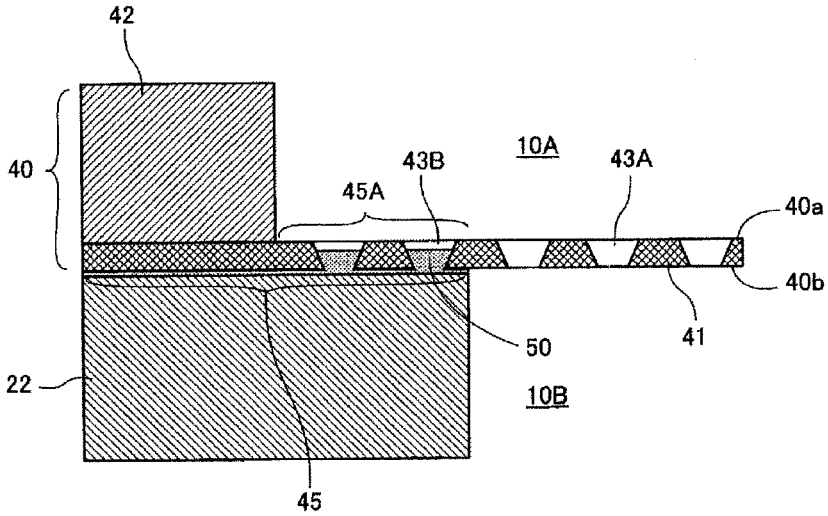
FIG. 4 is a cross-sectional diagram illustrating a main part of a peripheral part of a filter member according to the first embodiment.
Figure 5:
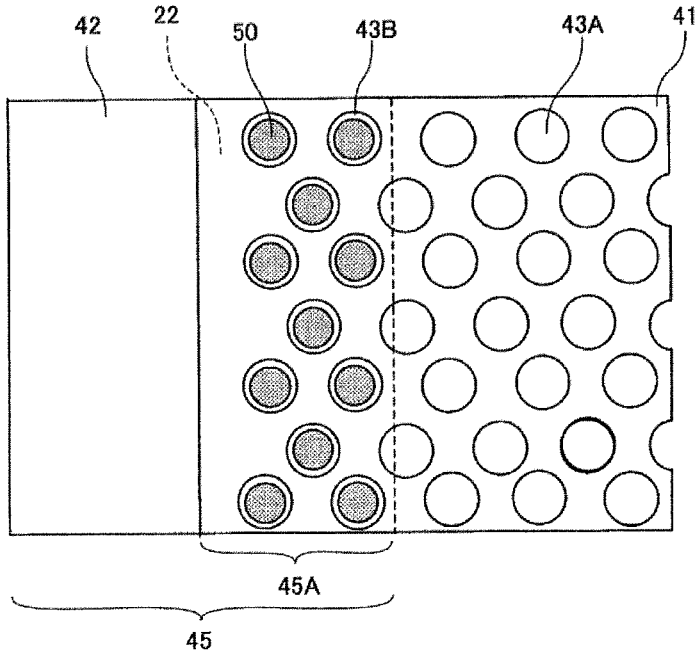
FIG. 5 is a plan diagram illustrating the filter member viewed from an upstream side.

Next, the liquid-jet head according to the first embodiment is described with reference to FIGS. 4 to 5. FIG. 4 is a cross-sectional diagram illustrating a main part of a peripheral part of a filter member according to the first embodiment, and FIG. 5 is a plan diagram illustrating the filter member viewed from an upstream side.

The filter member 40 includes a thin layer 41 having numerous pores 43A and 43B, and a thick layer 42 formed in a circumferential part of the thin layer 41. Since the filter member 40 is formed of the thin layer 41 and the thick layer 42, the handling of the filter member 40 having small openings (i.e., pores 43) may be improved without increasing pressure loss.

Note that the pores 43A and 43B have tapered cross-sectional configurations having opening areas on the upstream side (cross-sectional areas in a direction orthogonal to a liquid flowing direction) greater than opening areas on the downstream side. Further, the pores 43A serve as filter pores whereas the pores 43B do not serve as the filter pores. That is, the liquid does not flow through the pores 43B and therefore the pores 43B do not serve as the filter pores but may serve as an adhesive accumulating part.

The thick layer 42 of the filter member 40 is bonded to the first common liquid chamber member 21 with an adhesive. Further, the circumferential part 45 of a surface (i.e., a "downstream side filter surface 40*b*"), which is opposite to a surface having the thick layer 42 (i.e., an "upstream side filter surface 40*a*"), of the thin layer 41 of the filter member 40 is bonded to the second common liquid chamber member 22.

Note that the pores 43A and 43B are formed in the thin layer 41 of the filter member 40. The pores 43B are formed in a region (hereinafter called a "thin part") 45A formed of the thin layer 41 alone of the circumferential part 45 bonded to the second common liquid chamber member 22. The pores 43B disposed on the thick layer 42 side are exposed.

That is, an inner peripheral wall surface of the thick layer 42 of the filter member 40 is formed so as to be located outside an inner peripheral wall surface of the second common liquid chamber member 22 in a direction orthogonal to a liquid flowing direction. That is, a cross-sectional area (an opening area) in a direction orthogonal to a liquid flowing direction of the thick layer 42 is configured to be greater than a cross-sectional area (an opening area) in a direction orthogonal to a liquid flowing direction of the second common liquid chamber member 22.

Note that in the first embodiment, the pores 43B are formed only in the thin part 45A of the circumferential part 45 of the thin layer 41, where the thick layer 42 is not formed.

With this configuration, when the filter member 40 and the second common liquid chamber member 22 are bonded with an adhesive 50, the adhesive 50 overflows into the pores 43B. Since the adhesive 50 overflows into the pores 43B, a larger bonding area (a larger adhering area) of the thin layer 41 and the second common liquid chamber member 22 may be acquired. Accordingly, adhesive strength may be increased owing to the adhesive 50 inside the pores 43B serving as an anchor.

Further, the inner peripheral wall surface of the thick layer 42 of the filter member 40 is formed outside the inner peripheral wall surface of the second common liquid chamber member 22 in a direction orthogonal to the liquid flowing direction, such that the thick layer 42 side of the pores 43B formed on the thin part 45A of the filter member 40 are exposed. Accordingly, the adhesive 50 overflowing into the pores 43B may be prevented from overflowing into the filter region so as not to interfere with the flow of the filter region.

Further, the inner peripheral wall surface of the thick layer 42 of the filter member 40 is disposed outside the inner peripheral wall surface of the second common liquid chamber member 22 in a direction orthogonal to the liquid flowing direction. The thick layer 42 side of the pores 43B formed on the thin part 45A of the filter member 40 are exposed. Accordingly, accumulation of air bubbles on the downstream side of the filter member 40 may be reduced so as to improve air-bubble eliminating properties.

Figure 6:
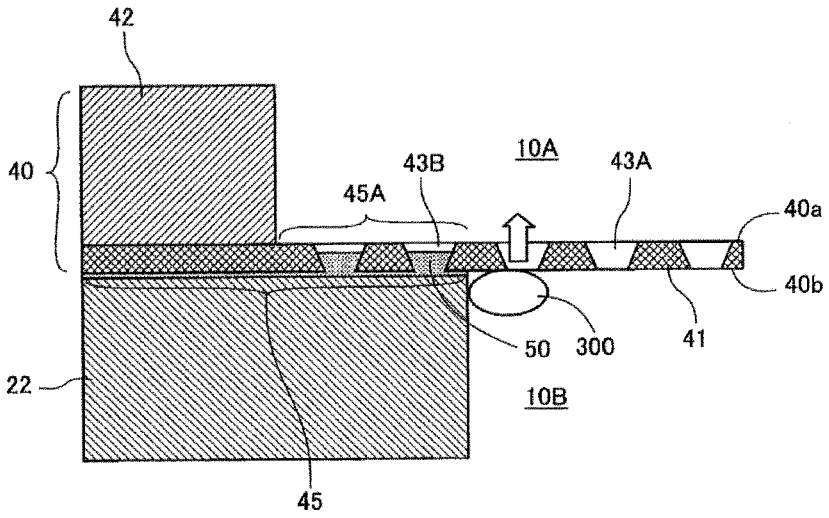
FIG. 6 is a cross-sectional diagram illustrating an action in the filter member according to the first embodiment.

That is, as illustrated in FIG. 6, when air bubbles 300 are attached to the inner peripheral wall surface of the downstream side common liquid chamber 10B, the air bubbles 300 attempt to pass through the pores 43 along the inner peripheral well surface of the filter member 40 due to buoyancy. Note that the cross-sectional area (the opening area) in the direction orthogonal to the liquid flowing direction of the thick layer 42 is greater than the cross-sectional area (the opening area) in the direction orthogonal to the liquid flowing direction of the second common liquid chamber member 22. Accordingly, when the air bubbles 300 move toward the upstream side common liquid chamber 10A, the movement of the air bubbles 300 will not be blocked off. Thus, the air bubbles 300 may easily move in the upstream side common liquid chamber 10A, thereby improving the air-bubble eliminating properties.

Figure 7A:
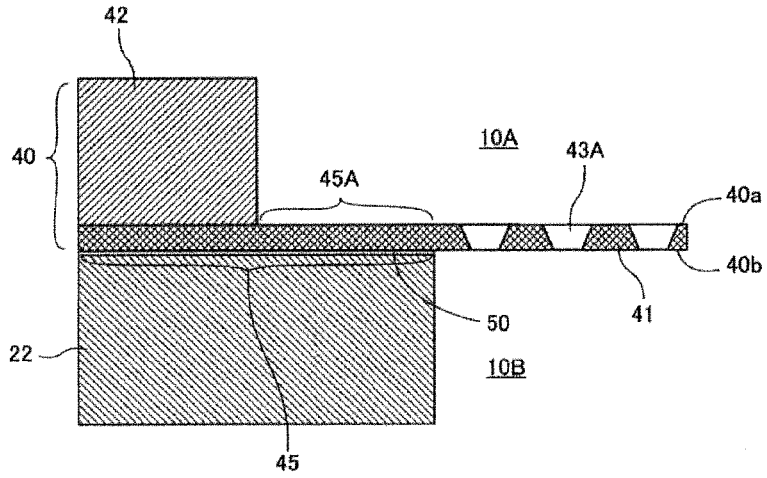
FIGS. 7A and 7B are cross-sectional diagrams each illustrating a main part of a peripheral part of a first comparative example of a filter member.
Figure 7B:
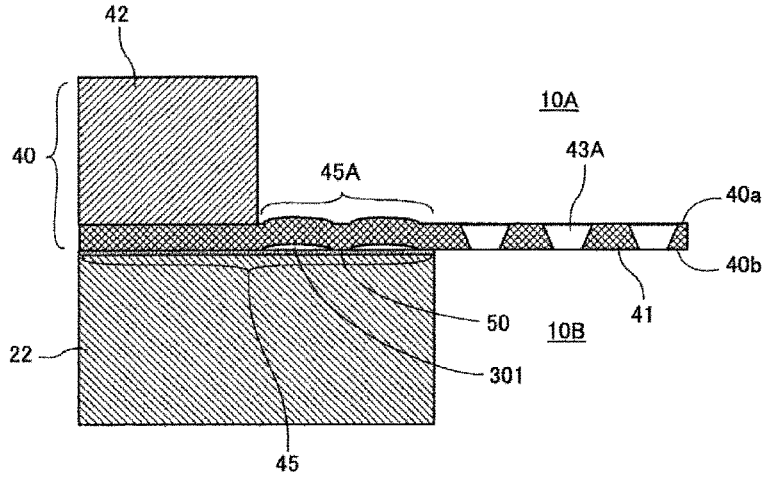

Note that first to third comparative examples are illustrated with reference to FIGS. 7A to 9 for clarifying the above-described advantages of the first embodiment. FIGS. 7A and 7B are cross-sectional diagrams each illustrating a main part of a peripheral part of the first comparative example of a filter member, FIG. 8 is a cross-sectional diagram illustrating a main part of a peripheral part of the second comparative example of a filter member, and FIG. 9 is a cross-sectional diagram illustrating a main part of a peripheral part of the third comparative example of a filter member.

The first comparative example illustrated in FIGS. 7A and 7B illustrates a configuration in which the pores 43B are not formed in the circumferential part 45 of the thin layer 41 including the thin part 45A where the thick layer 42 is not formed.

As illustrated in FIG. 7A, the filter member 40 is bonded to the second common liquid chamber member 22 with the adhesive 50 by pressing the thick layer 42 of the filter member 40. However, the thin part 45A is a non-pressed region to which no force is applied in the first comparative example. Further, the thin layer 41 has an extremely thin configuration that is easily deformed. As a result, the thin part 45A of the thin layer 41 has an adhesion failure part 301 due to floating or warping as illustrated in FIG. 7B.

Figure 8:
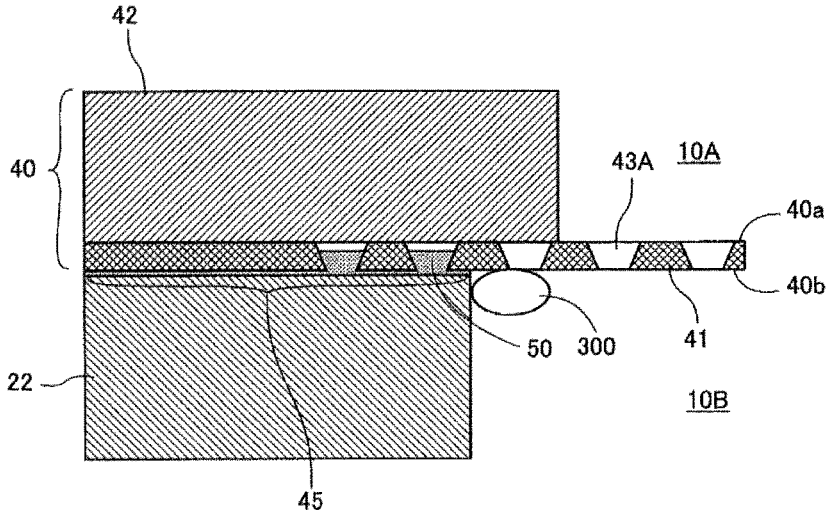
FIG. 8 is a cross-sectional diagram illustrating a main part of a peripheral part of a second comparative example of a filter member.
Figure 9:
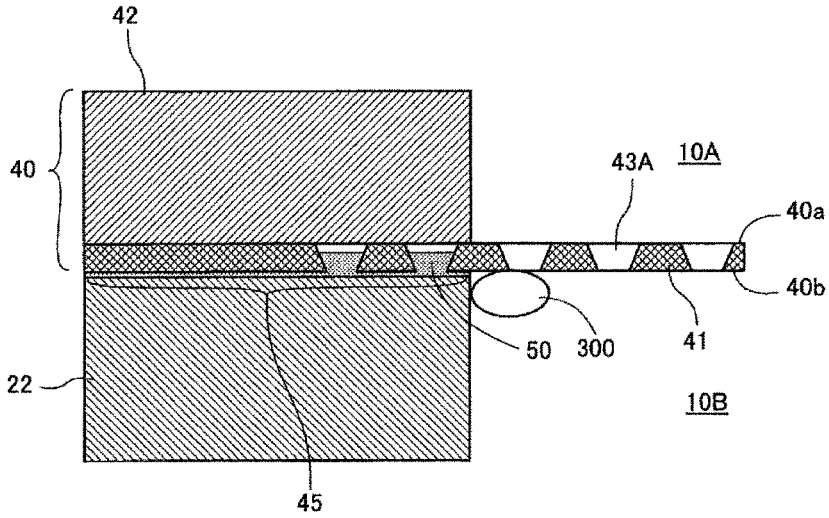
FIG. 9 is a cross-sectional diagram illustrating a main part of a peripheral part of a third comparative example of a filter member.

The second comparative example illustrated in FIG. 8 has a configuration in which a cross-sectional area (an opening area) in a direction orthogonal to a liquid flowing direction of the thick layer 42 of the filter member 40 is less than a cross-sectional area (an opening area) in a direction orthogonal to a liquid flowing direction of the second common liquid chamber member 22.

In the second comparative example, the air bubbles 300 attached to the inner peripheral wall surface of the downstream side common liquid chamber 103 that move along the inner peripheral wall surface of the filter member 10 are blocked off by the thick layer 42. Thus, since it becomes difficult for the air bubbles 300 to move toward the upstream side common liquid chamber 10A, the air bubbles 300 may easily be accumulated in the inner peripheral wall surface of the second common liquid chamber member 22.

The third comparative example illustrated in FIG. 9 has a configuration in which a cross-sectional area (an opening area) in a direction orthogonal to a liquid flowing direction of the thick layer 42 of the filter member 40 is equal to a cross-sectional area (an opening area) in a direction orthogonal to a liquid flowing direction of the second common liquid chamber member 22.

In the third comparative example, when the respective opening areas of the thick layer 42 and the second common liquid chamber 22 have equal dimensional accuracy such that the respective opening areas of the thick layer 42 and the second common liquid chamber 22 are mutually bonded without any positional shifts, the air-bubbles will not be accumulated. However, in practice, the air-bubble accumulation similar to that in the second comparative example may be observed since it is difficult to exclude dimensional variability or variability in the bonding accuracy of components from the configuration in the third comparative example.

Further, the first comparative example has a configuration in which there is no way out for the adhesive 50 to overflow. Hence, the adhesive 50 may overflow into the filter region side. Similarly, in the second and the third comparative examples, the pores 43B are covered with the thick layer 42. Accordingly, when the pores 43B fail to absorb a sufficient amount of the adhesive 50, the adhesive 50 may overflow into the filter region side.

By contrast, according to the configuration of the first embodiment, the adhesive strength may be acquired, so that the adhesive may be prevented from flowing into the filter region, and the air-bubble eliminating properties may be improved.

Figure 10:
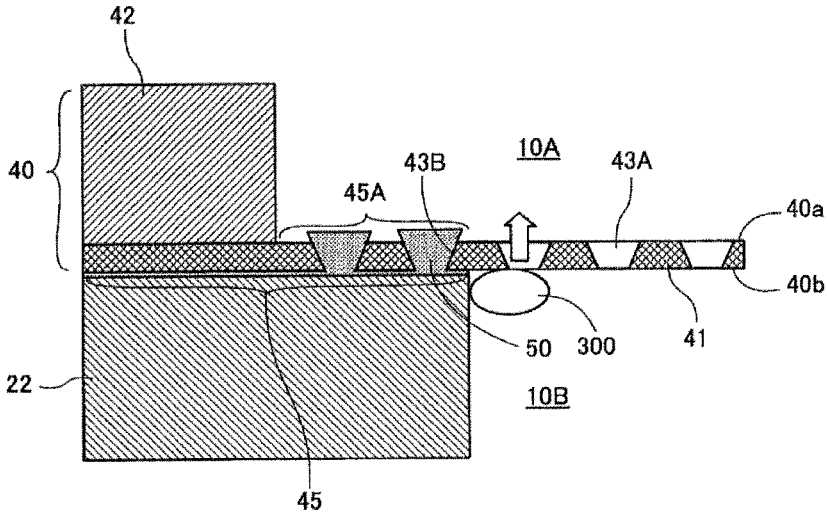
FIG. 10 is a cross-sectional diagram illustrating a main part of a peripheral part of a filter member according to a second embodiment.

Next, a liquid-jet head according to a third embodiment is described with reference to FIG. 10. FIG. 10 is a cross-sectional diagram illustrating a main part of a peripheral part of a filter member according to the second embodiment.

In the configuration according to the second embodiment, the adhesive 50 overflows from openings of the pores 43B formed in the thin part 45A of the filter member 40.

Accordingly, since the adhesive 50 overflowing from the openings of the pores 43B forms a rivet configuration, structural adhesive strength may be improved in addition to chemical adhesive strength of the adhesive 50, thereby further improving the adhesive strength.

Note that in order for the adhesive to overflow from the pores, the amount of the adhesive may be increased or the application of the pressure applied at the boding may be raised.

Figure 11:
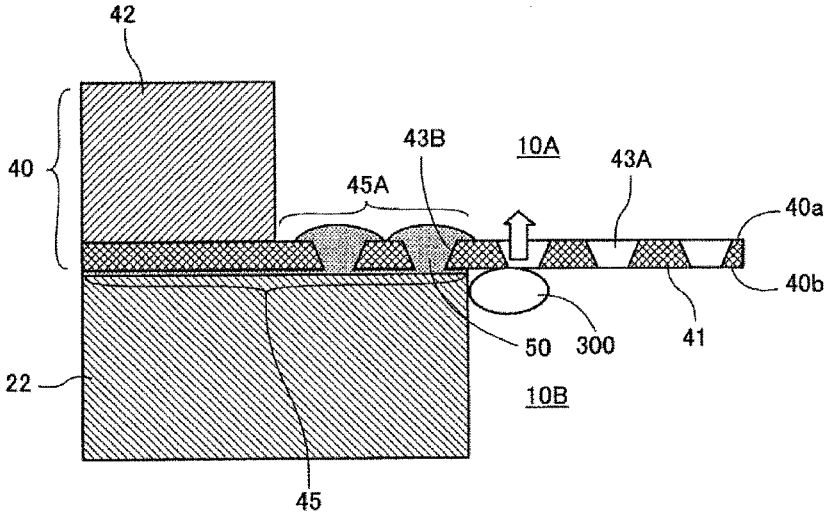
FIG. 11 is a cross-sectional diagram illustrating a main part of a peripheral part of a filter member according to a third embodiment.

Next, a liquid-jet head according to a third embodiment is described with reference to FIG. 11. FIG. 11 is a cross-sectional diagram illustrating a main part of a peripheral part of a filter member according to the third embodiment.

In the configuration according to the third embodiment, the adhesive 50 overflows from openings of the pores 43B formed in the thin part 45A of the filter member 40 such that the adhesive covers peripheries of the pores 43B. That is, a projection area of the overflowed adhesive 50 may be greater than the opening area of the pore 43B.

Thus, the configuration according to the third embodiment may improve adhesive strength to be greater than the configuration according to the second embodiment.

Figure 12:
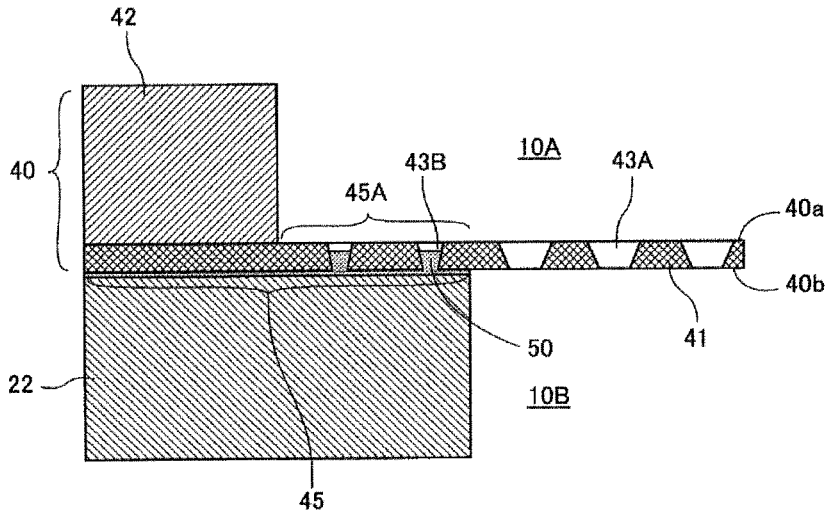
FIG. 12 is a cross-sectional diagram illustrating a main part of a peripheral part of a filter member according to a fourth embodiment.
Figure 13:
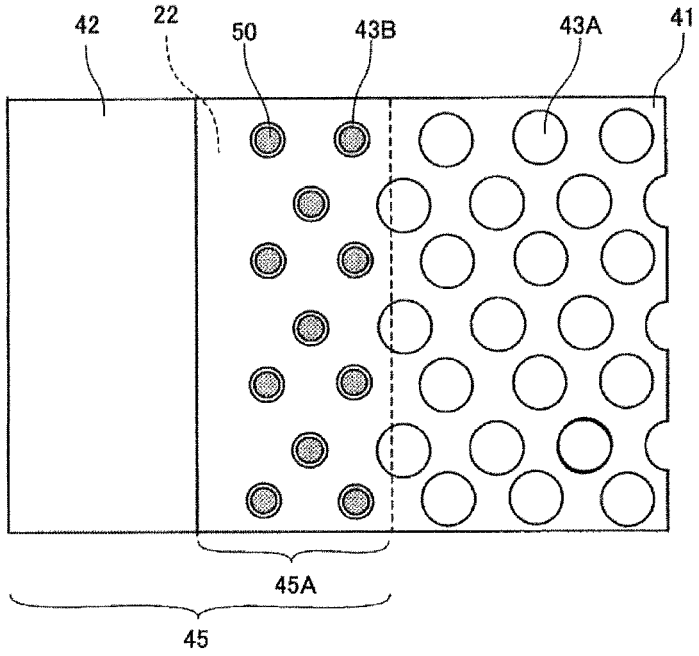
FIG. 13 is a plan diagram illustrating the filter member viewed from an upstream side.

Next, a liquid-jet head according to a fourth embodiment is described with reference to FIGS. 12 to 13. FIG. 12 is a cross-sectional diagram illustrating a main part of a peripheral part of a filter member according to the fourth embodiment, and FIG. 13 is a plan diagram illustrating the filter member viewed from an upstream side.

In the configuration according to the fourth embodiment, the pores 43B have an opening cross-sectional area (i.e., the mean) less than an opening cross-sectional area (i.e., the mean) of the pores 43A serving as the filter pores in the liquid flowing direction of the pores 43B formed in the thin part 45A. In this case, the number of pores 43B per unit area is equal to the number of pores 43A per unit area.

As described above, the opening cross-sectional area of the pores 43B in the thin part 45A is reduced in size to facilitate the adhesive 50 to exhibit wicking in the pores 43B owing to capillarity action. Thus, an anchoring effect may be easily acquired. Further, since the wicking adhesive 50 runs over to an upstream side of the filter surface 40*a*, the adhesive strength may further be improved by a rivet effect.

Figure 14:
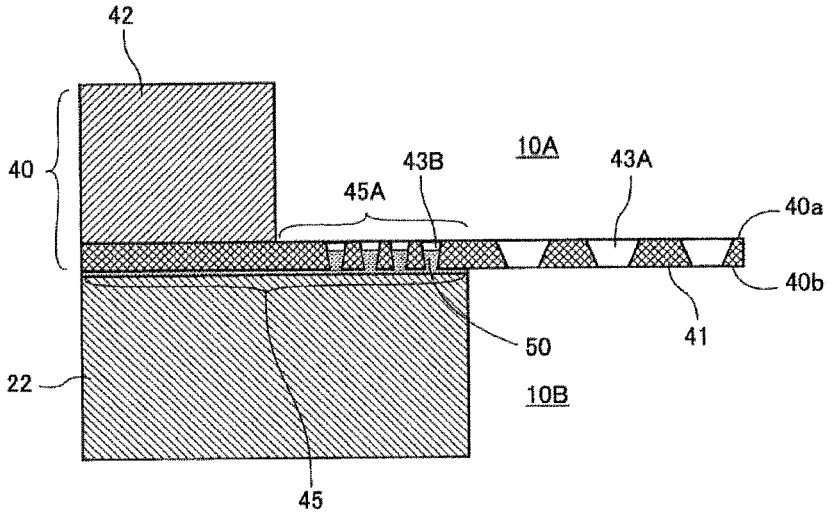
FIG. 14 is a cross-sectional diagram illustrating a main part of a peripheral part of a filter member according to a fifth embodiment.
Figure 15:
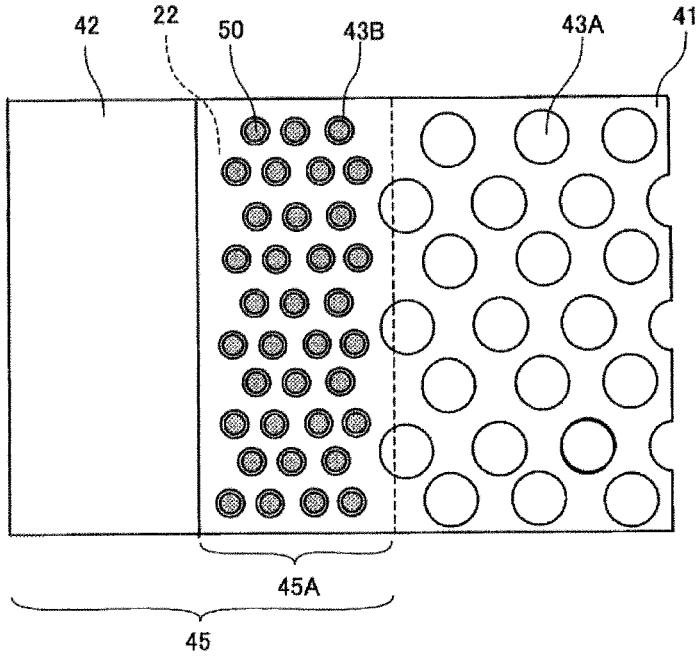
FIG. 15 is a plan diagram illustrating the filter member viewed from an upstream side.

Next, a liquid-jet head according to a fifth embodiment is described with reference to FIGS. 14 to 15. FIG. 14 is a cross-sectional diagram illustrating a main part of a peripheral part of a filter member according to the fifth embodiment, and FIG. 15 is a plan diagram illustrating the filter member viewed from an upstream side.

In the configuration according to the fifth embodiment, the number of pores 43B per unit area is greater than the number of pores 43A per unit area.

With this configuration, the adhesive strength acquired in the fifth embodiment may be higher than the adhesive strength in the fourth embodiment.

Note that insofar as the adhesive strength is acquired, the number of pores 430 per unit area may be decreased so as to be less than the number of pores 43A per unit area in the fifth embodiment.

Figure 16:
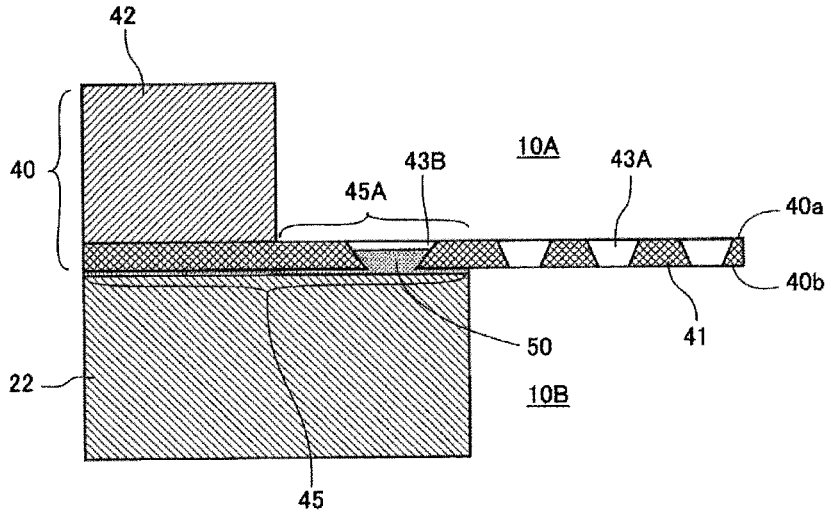
FIG. 16 is a cross-sectional diagram illustrating a main part of a peripheral part of a filter member according to a sixth embodiment.
Figure 17:
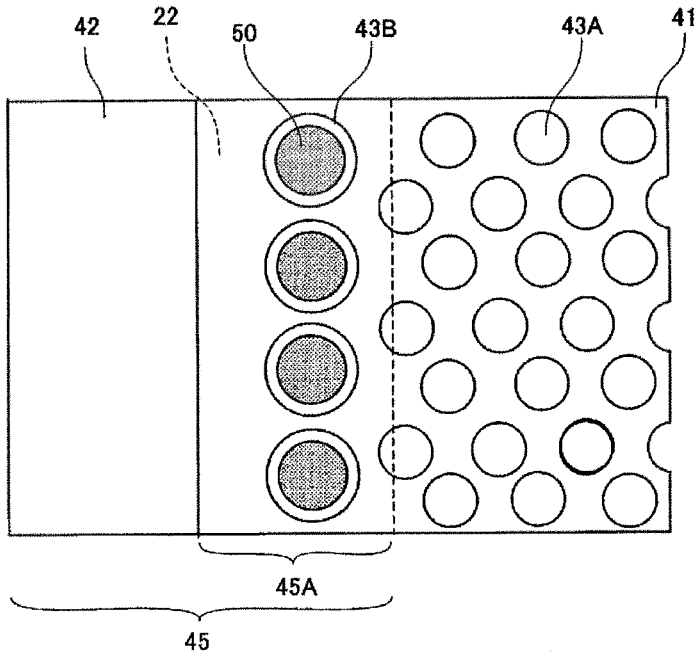
FIG. 17 is a plan diagram illustrating the filter member viewed from an upstream side.

Next, a liquid-jet head according to a sixth embodiment is described with reference to with reference to FIGS. 16 and 17. FIG. 16 is a cross-sectional diagram illustrating a main part of a peripheral part of a filter member according to the sixth embodiment, and FIG. 17 is a plan diagram illustrating the filter member viewed from an upstream side.

In the configuration according to the sixth embodiment, the pores 43B have an opening cross-sectional area (i.e., the mean) greater than an opening cross-sectional area (i.e., the mean) of the pores 43A serving as the filter pores in the liquid flowing direction of the pores 43B formed in the thin part 45A.

That is, it is preferable to increase the amount of the adhesive applied in order to suppress adhesion failure. However, when the amount of the adhesive is large, a flowing amount (a running amount) of the adhesive may be increased by the application of force. Thus, the filter area (i.e., an area of the region in which the pores 43A serving as the filter pores are formed) may be decreased.

Thus, since the large adhesive 50 accumulating part is acquired by enlarging the opening area of the pore 43B for releasing the adhesive 50, an excessive amount of the adhesive 50 may be prevented from flowing.

Figure 18:
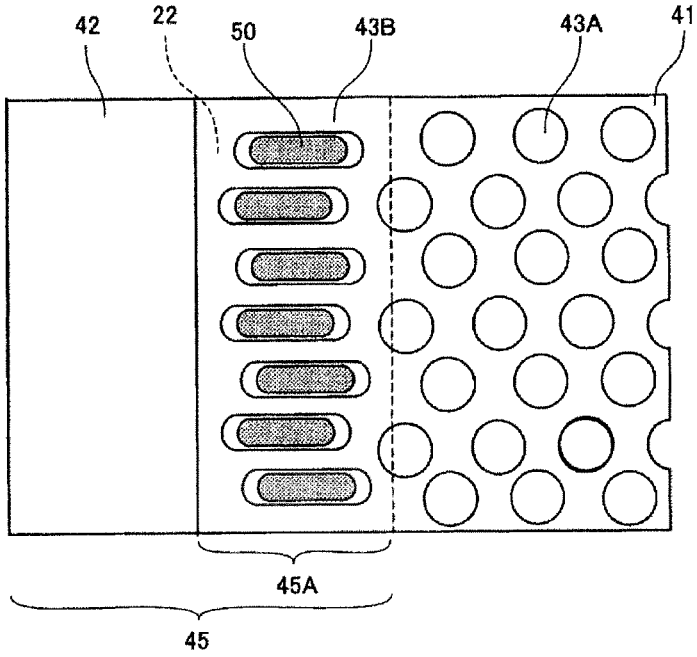
FIG. 18 is a cross-sectional diagram illustrating an example of a main part of a peripheral part of a filter member according to a seventh embodiment.
Figure 19:
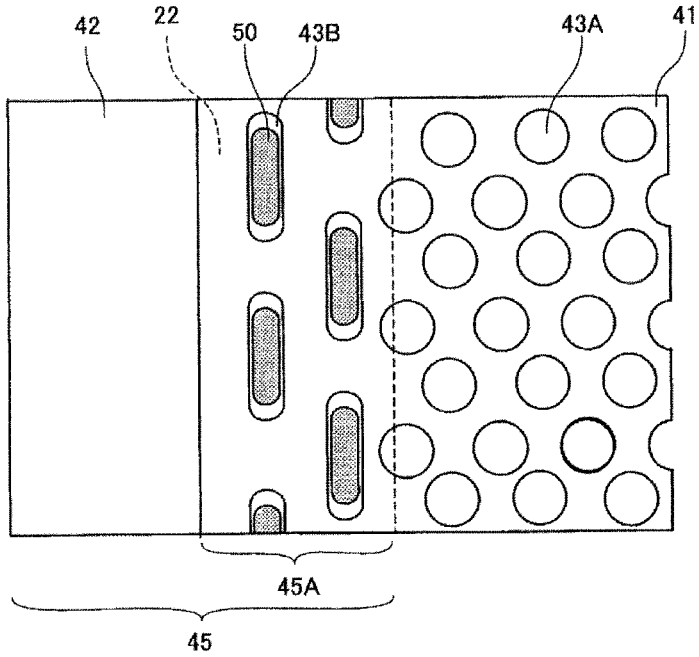
FIG. 19 is a cross-sectional diagram illustrating another example of the main part of the peripheral part of the filter member according to the seventh embodiment.

Next, a liquid-jet head according to a seventh embodiment is described with reference to FIGS. 18 to 19. FIG. 18 is a cross-sectional diagram illustrating an example of a main part of a peripheral part of a filter member according to a seventh embodiment, and FIG. 19 is a cross-sectional diagram illustrating another example of the main part of the peripheral part of the filter member according to the seventh embodiment.

In the configuration according to the seventh embodiment, the pores 43B each have an oblong shape in contrast to the pores 43B each having a circular shape in the configuration according to the sixth embodiment. In this case, the pores 43B may be disposed in a manner illustrated either in FIG. 18 or 19.

Figure 20:
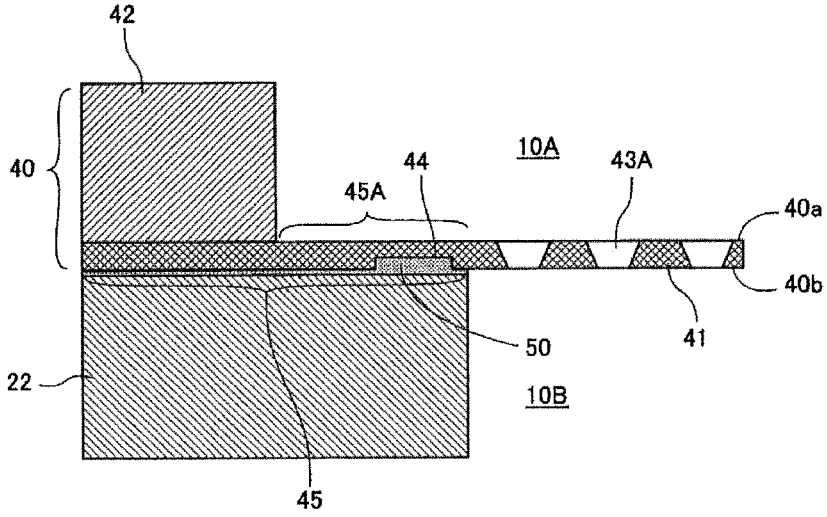
FIG. 20 is a cross-sectional diagram illustrating a main part of a peripheral part of a filter member according to an eighth embodiment.
Figure 21:
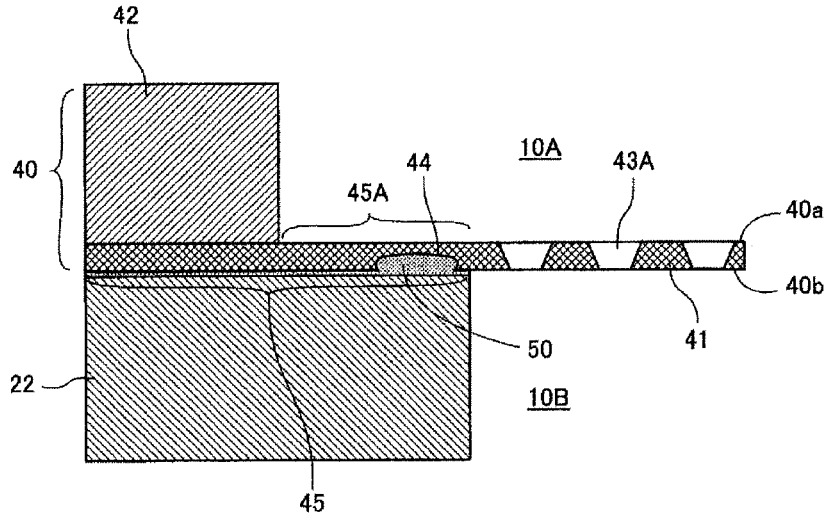
FIG. 21 is a cross-sectional diagram illustrating another example of the main part of the peripheral part of the filter member according to the eighth embodiment.

Next, a liquid-jet head according to an eighth embodiment is described with reference to FIGS. 20 to 21. FIG. 20 is a cross-sectional diagram illustrating a main part of a peripheral part of a filter member according to an eighth embodiment, and FIG. 21 is a cross-sectional diagram illustrating another example of the main part of the peripheral part of the filter member according to the eighth embodiment.

In the configuration according to the eighth embodiment, a recess part 44 having an opening on the second common liquid chamber member 22 side is formed in the thin part 45A serving as a bonding region of the filter member 40 and the second common liquid chamber member 22. The recess part 44 may have a rectangular shape as illustrated in FIG. 20 or a troffer shape as illustrated in FIG. 21.

Thus, the adhesive 50 flows into the recess part 44 that is formed in the thin part 45A, so that an anchoring effect may be acquired. That is, even if the bonding area (i.e., the thin part 45A) is reduced in size, sufficient adhesive strength may be acquired.

Figure 22:
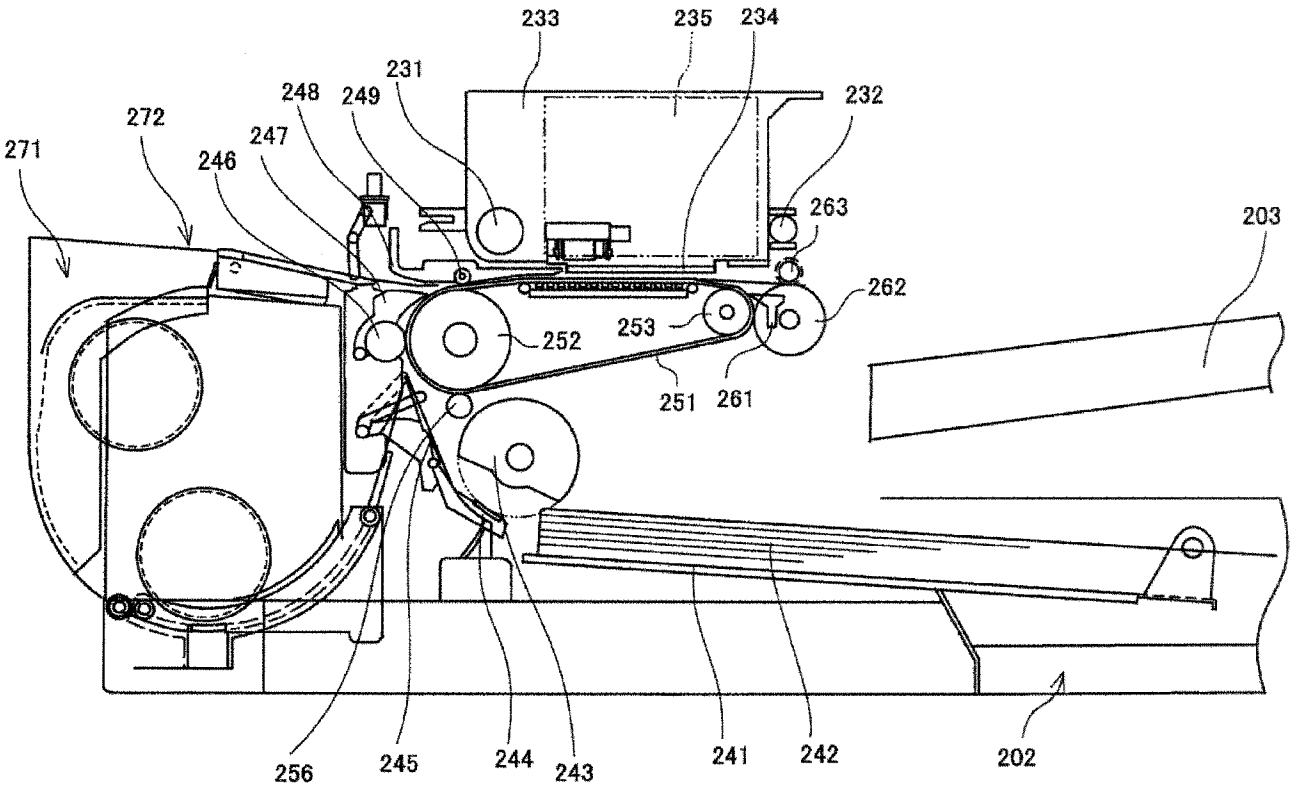
FIG. 22 is a side diagram illustrating an example of a mechanical part of an image forming apparatus having the liquid-jet head according to one of the embodiments.
Figure 23:
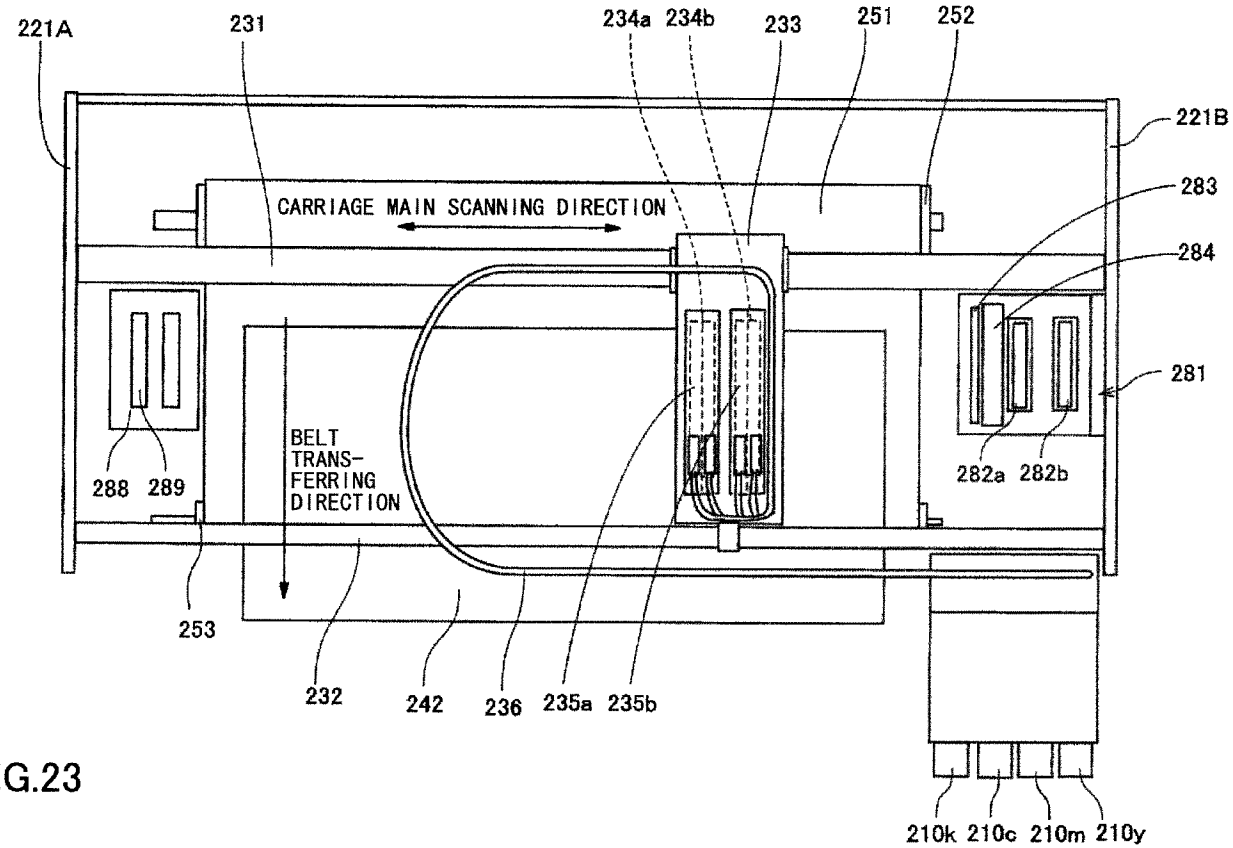
FIG. 23 is a plan diagram illustrating a main part of the mechanical part.

Next, an example of an image forming apparatus having a liquid-jet head according to an embodiment is described with reference to FIGS. 22 and 23. Note that FIG. 22 is a side diagram illustrating an example of a mechanical part of an image forming apparatus having the liquid-jet head according to the embodiments, and FIG. 23 is a plan diagram illustrating a main part of the mechanical part.

The image forming apparatus is a serial-type image forming apparatus. The serial-type image forming apparatus includes a carriage 233 that is slidably supported in main-scanning directions by a driving guide rod 231 and a driven guide rod 232 serving as guide members bridging between left-side and right-side plates 21A and 21B, and that is moved while scanning via a timing belt in arrow directions (carriage main-scanning directions) by a not-shown main-scanning motor.

The carriage 233 includes a recording head 234 integrally having liquid-jet heads having nozzles respectively ejecting ink drops of yellow (Y), cyan (C), magenta (M), and black (K), and ink tanks containing ink to be supplied to the respective liquid-jet heads. In the recording head 234 integrally having the liquid-jet heads and the respective ink tanks, a nozzle array formed of the nozzles held by the recording head 234 is disposed in a sub-scanning direction orthogonal to the main-scanning directions, and ink ejecting directions of the nozzles are downward.

The recording head 234 includes first and second recording heads 234*a* and 234*b*. Each of the recording heads 234*a* and 234*b* has two nozzle arrays. One of the nozzle arrays of the first recording head 234*a* is configured to eject black (K) liquid drops, and the other nozzle array of the first recording head 234*a* is configured to eject cyan (C) liquid drops. One of the nozzle arrays of the second recording head 234*b* is configured to eject magenta (M) liquid drops, and the other nozzle array of the second recording head 234*b* is configured to eject yellow (Y) liquid drops. Note that in this example, the recording head 234 has a two-head configuration for ejecting four color liquid drops; however, the recording head may have a one-head configuration having four nozzle arrays per head for ejecting four color liquid drops.

The ink tank 235 (i.e., ink tanks 235*a* and 235*b*) of the recording head 234 is supplied with respective colors of ink from respective colors of ink cartridges 210 via respective colors of supply tubes 236.

The serial-type image forming apparatus further includes a semicircular (sheet-feeding) roll 243 and a separation pad 244 made of a material having a high friction coefficient and directed to face the sheet-feeding roller 243. The sheet-feeding roll 243 and the separation pad 244 are used as a sheet-feeding part for feeding sheets 242 accumulated on a sheet-accumulating part (platen) 241 of a sheet-feeding tray 202. The sheet-feeding part composed of the sheet-feeding roller 243 and the separation pad 244 is configured to feed one sheet 242 at a time from the sheet-accumulating part 241, and the separation pad 244 is biased toward the sheet-feeding roller 243 side.

The serial-type image forming apparatus further includes a guide member 245 for guiding the sheet 242, a counter roller 246, a transfer guide member 247, an edge-pressing roll 249, and a presser member 248 in order to transfer the sheet 242 fed from the sheet-feeding part to a lower side of the recording head 234. The serial-type image forming apparatus also includes a transfer belt 251 to electrostatically attract the sheet 242 to transfer the sheet 242 to a position facing the recording head 234.

The transfer belt 251 is formed of an endless belt that is looped over a transfer roller 252 and a tension roller 253 so as to rotationally travel in a belt transferring direction (i.e., the sub-scanning direction). Further, the serial-type image forming apparatus further includes a charging roller 256 serving as a charging part configured to electrically charge a surface of the transfer belt 251. The charging roller 256 is disposed such that the charging roller 256 is brought into contact with a surface layer of the transfer belt 251 to be rotationally driven by the rotation of the transfer belt 251. The transfer belt 251 circumferentially travels in the belt transferring direction driven by the transfer roller 252 that is rotationally driven by a not-illustrated sub-scanning motor via the timing belt.

The serial-type image forming apparatus further includes a sheet-discharging part. The sheet-discharging part includes a separation claw 261 for separating the sheet 242 from the transfer belt 251, a sheet-discharge roller 262, a sheet-discharge spur 263, and a sheet-discharge tray 203 disposed at a lower side of the sheet-discharge roller 262.

The serial-type image forming apparatus further includes a duplex-printing unit 271 detachably attached at the back of the main body of the serial-type image forming apparatus. The duplex-printing unit 271 captures the sheet 242 rotationally transferred in a reverse direction of the transfer belt 251, reverses the sheet 242, and then feeds the reversed sheet 42 between the counter roller 246 and the transfer belt 251. The serial-type image forming apparatus further includes a manual bypass tray 272 on top of the duplex-printing unit 271.

The serial-type image forming apparatus further includes a maintenance-restoration mechanism 281 serving as a head maintenance-restoration device including a restoration unit for maintaining and restoring the nozzle states of the recording head 234 in a non-printing region at one side of the carriage 233 in the carriage main-scanning direction. The maintenance-restoration mechanism 281 includes cap members 282*a* to 282*d* (hereinafter called "caps 282*a* to 282*d*" or simply called a "cap 282" as a generic name for the cap members 282*a* to 282*d*) for capping the respective nozzle faces of the liquid-jet recording head 234, a wiper blade 283 serving as a wiper blade member for wiping the nozzle faces and a discharged non-printing ink receiver 284 for receiving non-printing ink discharged from the liquid-jet head 284 when the thickened recording liquid is discharged as non-printing ink, due to its failure to function as the recording liquid.

The serial-type image forming apparatus further includes a non-printing ink receiver 288 in a non-printing region at the other side of the carriage 233 in the carriage main-scanning direction so as to receive the non-printing ink when the recording liquid is thickened and the thickened recording liquid is thus discharged. The non-printing ink receiver 288 includes an opening 289 along the nozzle array direction of the recording head 234.

In the image forming apparatus having the above configuration, the top sheet 242 is separated from the others in the sheet-feeding tray 202, the sheet 242 is approximately vertically disposed to be guided by the guide member 245, the sheet 242 is sandwiched between the transfer belt 251 and the counter roller 246 to be transferred, the edge of the sheet 242 is guided by the transfer guide member 247, and pressed against the transfer belt 251 by the edge-pressing roll 249, and by then the transfer direction of the sheet 242 is changed by approximately 90 degrees.

In this state, voltages are alternately applied to the charging roller 256 to repeatedly output plus and minus charges, such that the transfer belt 251 is charged with alternate charge voltage patterns corresponding to the charging roller 256. That is, the transfer belt 251 is charged such that the transfer belt 251 includes alternately disposed plus and minus charged bands having predetermined widths in the sub-scanning direction (i.e., a circumferential traveling direction of the transfer belt 251). When the sheet 242 is fed onto the transfer belt 251 that is alternately charged with plus and minus charge voltage patterns, the sheet 242 is electrostatically attracted by the transfer belt 251. The sheet 242 attracted to the transfer belt 251 is then transferred in the sub-scanning direction by circumferential traveling of the transfer belt 251.

The recording head 234 is driven based on image signals while the carriage 233 is moved such that the recording head 234 ejects ink drops onto the stationary sheet 242, thereby recording one line with the ejected ink drops. The sheet 242 is then transferred by a predetermined amount, and a next line is subsequently recorded on the sheet 242 with next ejected ink drops. The recording operation is terminated when a signal indicates that a rear end of the sheet 242 has reached a recording region. The sheet 242 is discharged onto the sheet-discharge tray 203.

Since the serial-type image forming apparatus includes the liquid-jet recording head according to the embodiments as the recording head, high-definition images may be stably formed.

Note that in the present application, a material of the "sheet" is not limited to paper, but may be an overhead projector (OHP) film, cloth, glass, and a substrate, to which ink drops or other liquids are attachable. Examples of such materials for the sheet may be called a "recording medium subject to being recorded on", a "recording medium", "recording paper", and a "recording sheet". Further, the terms "image forming", "recording", "printing", and "copying" may be used as synonyms.

In addition, the term an "image forming apparatus" indicates an apparatus that forms an image onto media such as paper, string, fiber, fabric, leather, metal, plastic, glass, wood, and ceramics by discharging liquid onto such media. Moreover, the term "forming an image" or "image formation" not only indicates providing an image having some kind of meaning onto the media such as characters and symbols, but also indicates an image without having any meaning such as patterns (i.e., by simply discharging ink drops onto the media).

Further, the term"ink" is not specifically limited to those generally called "ink", but may include a generically called "liquid" capable of forming an image, such as a recording liquid, a fixing liquid, and a liquid. The term "ink" may further include DNA specimens, resist, a patterning material, resin, and the like.

Moreover, the "image" is not limited a two-dimensional image, but may include an image applied to a three-dimensionally formed object, or an image applied to a three-dimensional image formed of a molded object.

Further, the term "image forming apparatus" may include both a "serial-type image forming apparatus" and a "line-type image forming apparatus" unless otherwise specified.

In the image forming apparatus according to the above-described embodiments, it may be possible to prevent the adhesive bonding the filter member from overflowing the edge of the filter into the filter region while improving the air-bubble eliminating properties.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of superiority or inferiority of the invention. Although the embodiment of the present invention has been described in detail, it should be understood that various changes, substitutions, and alterations could be made hereto without departing from the spirit and scope of the invention.

This patent application is based on Japanese Priority Patent Application No. 2012-055525 filed on Mar. 13, 2012, the entire contents of which are hereby incorporated herein by reference.

What is claimed is:

1. A liquid-jet head comprising:

a plurality of nozzles configured to eject liquid drops;

a plurality of individual liquid chambers in communication with the nozzles;

a common liquid chamber configured to supply the liquid to the individual liquid chambers; and a filter member configured to filter the liquid inside the common liquid chamber, wherein the common liquid chamber includes a first common liquid chamber member on an upstream side of the filter member, and a second common liquid chamber member on a downstream side of the filter member, the filter member includes (a) a thin layer comprising a plurality of pores and (b) a thick layer having at least a portion thereof disposed on a surface of a circumferential part of the thin layer, and said at least a portion of the thick layer disposed on the surface of the circumferential part of the thin layer is thicker than the thin layer, the thick layer of the filter member is bonded to the first common liquid chamber member, the thin layer of the filter member includes a first surface on which the thick layer is formed and a second surface opposite to the first surface, a circumferential part of the second surface of the thin layer being bonded to the second common liquid chamber member with an adhesive, among the pores formed in the thin layer of the filter member, at least some of the pores are formed in the circumferential part of the thin layer, said at least some of the pores formed in the circumferential part of the second surface of the thin layer include adhesive accumulating pores into which the adhesive overflowed, the adhesive accumulating pores into which the adhesive overflowed are exposed on a thick layer side of the pores, and the adhesive accumulating pores are disposed in an area of the thin layer which is between an area of the thin layer on which the thick layer is formed and an area of the thin layer where filter pores in which the liquid flows is formed.

2. The liquid-jet head as claimed in claim 1, wherein an inner peripheral wall surface of the thick layer of the filter member is formed to be disposed outside an inner peripheral wall surface of the second common liquid chamber member in a direction orthogonal to a liquid flowing direction.

3. The liquid-jet head as claimed in claim 1, wherein among the pores formed in the thin layer of the filter member, the pores formed in the circumferential part of the second surface of the thin layer have opening areas greater than opening areas of pores within a region into which a liquid flows.

4. The liquid-jet head as claimed in claim 1, wherein a recess part is formed in the circumferential part of the thin layer of the filter member, the recess part being opened in a direction toward the second common liquid chamber member, and a part or all of the circumferential part having the recess part of the thin layer of the filter member is exposed in a direction toward the thick layer.

5. An image forming apparatus comprising the liquid-jet head as claimed in claim 1.

6. The liquid-jet head as claimed in claim 1, wherein no adhesive overflowed into the filter pores in which the liquid flows.

7. The liquid-jet head as claimed in claim 1, wherein the adhesive overflowed into at least some of the adhesive accumulating pores form a rivet shape in said at least some of the adhesive accumulating pores.

8. A liquid-jet head comprising:

a plurality of nozzles configured to eject liquid drops;

a plurality of individual liquid chambers in communication with the nozzles;

a common liquid chamber configured to supply the liquid to the individual liquid chambers; and a filter member configured to filter the liquid inside the common liquid chamber, wherein the common liquid chamber includes a first common liquid chamber member on an upstream side of the filter member, and a second common liquid chamber member on a downstream side of the filter member, the filter member includes a thin layer having a plurality of pores and a thick layer disposed on a circumferential part of the thin layer, the thick layer of the filter member is bonded to the first common liquid chamber member, the thin layer of the filter member includes a first surface on which the thick layer is formed and a second surface opposite to the first surface, a circumferential part of the second surface of the thin layer being bonded to the second common liquid chamber member with an adhesive, among the pores formed in the thin layer of the filter member, a part or all of the pores are exposed in a direction toward the thick layer, the part or the all of the pores being formed in the circumferential part of the second surface of the thin layer bonded to the second common liquid chamber, and the adhesive overflows into the part or the all of the pores formed in the circumferential part of the second surface of the thin layer, wherein among the pores formed in the thin layer of the filter member, the pores formed in the circumferential part of the second surface of the thin layer have opening areas less than opening areas of pores within a region into which a liquid flows.

9. A liquid-jet head comprising:

a plurality of nozzles configured to eject liquid drops;

a plurality of individual liquid chambers in communication with the nozzles;

a common liquid chamber configured to supply the liquid to the individual liquid chambers; and a filter member configured to filter the liquid inside the common liquid chamber, wherein the common liquid chamber includes a first common liquid chamber member on an upstream side of the filter member, and a second common liquid chamber member on a downstream side of the filter member, the filter member includes (a) a thin layer comprising a plurality of pores and (b) a thick layer having at least a portion thereof disposed on a surface of a circumferential part of the thin layer, and said at least a portion of the thick layer disposed on the surface of the circumferential part of the thin layer is thicker than the thin layer, the thick layer of the filter member is bonded to the first common liquid chamber member, the thin layer of the filter member includes a first surface on which the thick layer is formed and a second surface opposite to the first surface, a circumferential part of the second surface of the thin layer being bonded to the second common liquid chamber member with an adhesive, among the pores formed in the thin of the filter member, a part or all of the pores, are exposed in a direction toward the thick layer, and at least some of the pores formed in the circumferential part of the second surface of the thin layer are bonded to the second common liquid chamber, and the adhesive overflows into the part or the all of the pores formed in the circumferential part of the second surface of the thin layer, and among the pores formed in the thin layer of the filter member, the pores formed in the circumferential part of the second surface of the thin layer have opening areas smaller than opening areas of pores within a region into which the liquid flows.

* * * * *